US005924410A

United States Patent [19]

Dumas et al.

[11] Patent Number: 5,924,410

[45] Date of Patent: Jul. 20, 1999

[54] EVAPORATIVE EMISSION CANISTER FOR AN AUTOMOTIVE VEHICLE

[75] Inventors: James T. Dumas, Clinton Township; Philip Jeffrey Johnson, Ann Arbor; Gregory S. Green, Rochester Hills; Roger Khami, Troy, all of Mich.

[73] Assignee: Ford Motor Company, Dearborn, Mich.

[21] Appl. No.: 09/118,978

[22] Filed: Jul. 20, 1998

[51] Int. Cl.[6] ..... F02M 37/04

[52] U.S. Cl. ..... 123/519; 123/516

[58] Field of Search ..... 123/520, 521, 123/519, 518, 516, 198 D

[56] References Cited

U.S. PATENT DOCUMENTS

| | | | |
|---|---|---|---|
| 4,766,872 | 8/1988 | Kato | 123/519 |
| 4,853,009 | 8/1989 | Turner et al. . | |
| 5,148,793 | 9/1992 | Reddy . | |
| 5,337,721 | 8/1994 | Kasuya et al. . | |
| 5,456,237 | 10/1995 | Yamazaki | 123/520 |
| 5,460,136 | 10/1995 | Yamazaki et al. . | |
| 5,538,543 | 7/1996 | Watanabe et al. . | |
| 5,599,384 | 2/1997 | Yoshida | 123/519 |
| 5,632,251 | 5/1997 | Ishikawa | 123/519 |
| 5,653,211 | 8/1997 | Ishikawa . | |
| 5,743,943 | 4/1998 | Maeda | 123/519 |

*Primary Examiner*—Carl S. Miller
*Attorney, Agent, or Firm*—Neil P. Ferraro

[57] ABSTRACT

An automotive evaporative emissions canister includes a housing containing a hydrocarbon adsorbing material, such as carbon. The canister includes a vent port for venting air to the atmosphere upon adsorption of hydrocarbons and for admitting air upon the desorption of hydrocarbon during the purging operation of the canister. A purge port is adapted for connection to the engine to allow the desorbed hydrocarbons to flow into the engine. A plurality of holes is formed through the side wall of the canister housing and are formed at a location remote from the purge port between the vent port and the purge port to define a buffer zone. The holes are adapted for communication with the fuel tank to allow fuel vapor to flow through the tank through the plurality of holes into the buffer zone. Thus, vapor purged directly from the tank to the engine is buffered through the carbon canister to prevent any vapor purge spikes creating the undesirably over-rich condition.

18 Claims, 2 Drawing Sheets

EVAPORATIVE EMISSION CANISTER FOR AN AUTOMOTIVE VEHICLE

FIELD OF THE INVENTION

This invention relates to evaporative emission systems for automotive vehicles, and more particularly to, evaporative emissions buffer canisters.

BACKGROUND OF THE INVENTION

Conventional automotive evaporative systems include a carbon canister communicating with a fuel tank to adsorb fuel vapors from the fuel tank. The carbon canister adsorbs the fuel vapor until it is saturated, at which time, the fuel vapor is desorbed from the carbon canister by drawing fresh air therethrough. Such a system is shown in FIG. 1. System 10 includes fuel tank 12 coupled to carbon canister 14 and engine 16 via vapor purge lines 17 and 24, respectively. Fuel vapor from tank 12 flows through line 17 into canister 14, where the fuel is adsorbed onto the carbon. Fresh air is then emitted through vent port 18 to atmosphere. When the canister becomes saturated with fuel, engine controller 19 command valves 20 to open so that the fuel may be desorbed from the carbon and flow to engine 16 via purge line 24.

Occasionally, it may be necessary to purge the canister when both the canister is full and a large vapor volume exists in the fuel tank. Thus, upon purging, in the system described with reference to FIG. 1, vapor is drawn from both the canister and the engine. As a result, the large vapor volume flowing directly from the tank to the engine may cause the engine to temporary run in an undesirably rich condition. To prevent this, a relatively small carbon canister 26, typically termed a buffer canister, is disposed between the fuel tank and the engine. This buffer canister 26, due to its relatively small size, quickly saturates such that the vapors flowing to the engine may break through the carbon bed to be consumed by the engine. The effect of the buffer canister is to reduce any large hydrocarbon or fuel vapor spikes going to the engine to prevent the over rich condition. In other words, the buffer canister acts to dampen any fuel vapor spikes typically flowing directly from the fuel tank to the engine.

The disadvantage with this approach is primarily due to the fact that a secondary canister must be utilized in the system. This creates added expense due to couplings, vapor lines, associated hardware and general system complexity. To overcome these disadvantages, some systems utilize a vapor purge line flowing directly from the tank to the primary carbon canister, with the purge line being embedded into the carbon bed. Such a system is depicted in FIG. 2. In this system, when fuel vapor from the fuel tank 12 is to be purged directly into engine 16, the fuel vapor must at least go through a portion of the primary carbon canister, shown at bracket 28. Thus, a portion of the canister acts to buffer any hydrocarbon spikes from the fuel tank.

The inventors of the present invention have found certain disadvantages with the system described in FIG. 2. For example, in order to utilize a portion of the primary canister as a buffer, fuel vapor line 17 must necessarily penetrate into the carbon bed. Because of this, manufacturing issues arise in that the vapor purge line must be sealed in a manner so as to prevent leakage between the line and the atmosphere at the intersection with the primary canister. In addition, the purge line must contain a screen or filter to prevent the carbon from dislodging from the canister. Furthermore, the amount of penetration is determined on a vehicle line basis. Thus, a relatively small engine may require a certain volume for the buffer whereas a relatively large engine may require a different volume. This fact requires unique manufacturing tooling to precisely locate the depth of the fuel tank purge line within the carbon canister.

SUMMARY OF THE INVENTION

An object of the present invention is to provide an easily manufacturable carbon canister having a buffer zone incorporated therein. This object is achieved, and disadvantages of prior art are overcome, by providing a novel evaporative emission canister for an evaporative emission system. The system includes a fuel tank coupled to an engine via a vapor purge line. The canister, in turn, is coupled to the fuel tank and the engine. In one particular aspect of the invention, the canister includes a housing having sidewalls and a top wall. The housing contains hydrocarbon adsorbing material for adsorbing hydrocarbons from fuel vapor flowing therethrough. A vent port for venting air to atmosphere upon adsorption of hydrocarbons and for admitting air upon desorption of hydrocarbons during a purging operation of the canister is formed on the canister housing. A purge port, adapted for connection to the engine to allow desorbed hydrocarbon to flow thereto, is also formed on the housing. A plurality of holes is formed through a sidewall of the housing at a location remote from the purge port between the vent port and the purge port to define a buffer zone between the holes and the purge port. The holes are adapted for communication with the fuel tank to allow fuel vapor to flow from the tank through the plurality of holes into the buffer zone.

By attaching the fuel vapor line from the tank to the engine directly to the exterior of the carbon canister, manufacturing advantages are realized. For example, a standard carbon canister may be quickly modified to be used in a vehicle requiring a buffer canister. This allows for commonality of manufacturing processes, while reducing manufacturing expenses.

Accordingly, an advantage of the present invention is ease of manufacturability and reduced manufacturing costs.

Another advantage of the present invention is that a carbon canister having different buffering zones may be quickly manufactured.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
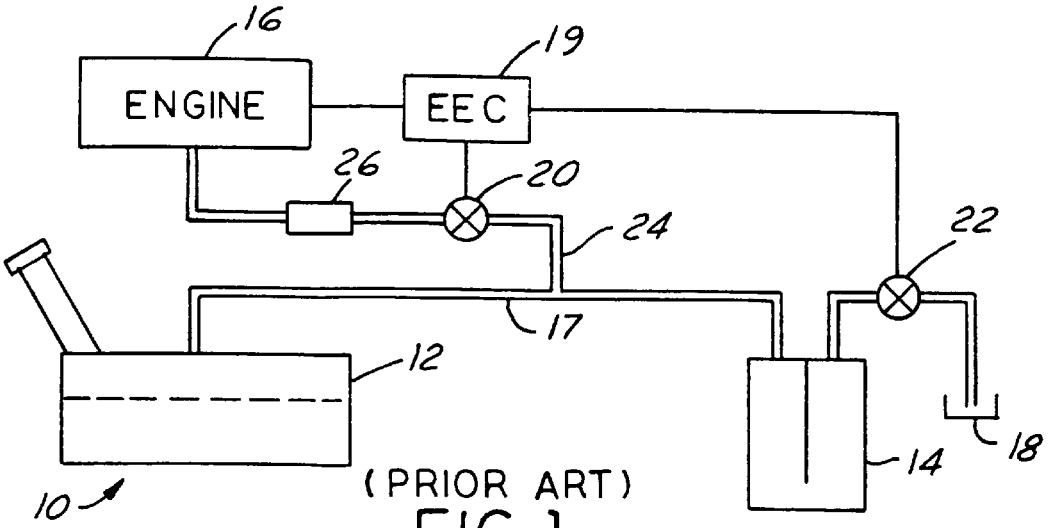
(PRIOR ART) FIG. 1
FIGS. 1 and 2 are schematic representations of prior art evaporative emissions systems for automotive vehicles.
Figure 2:
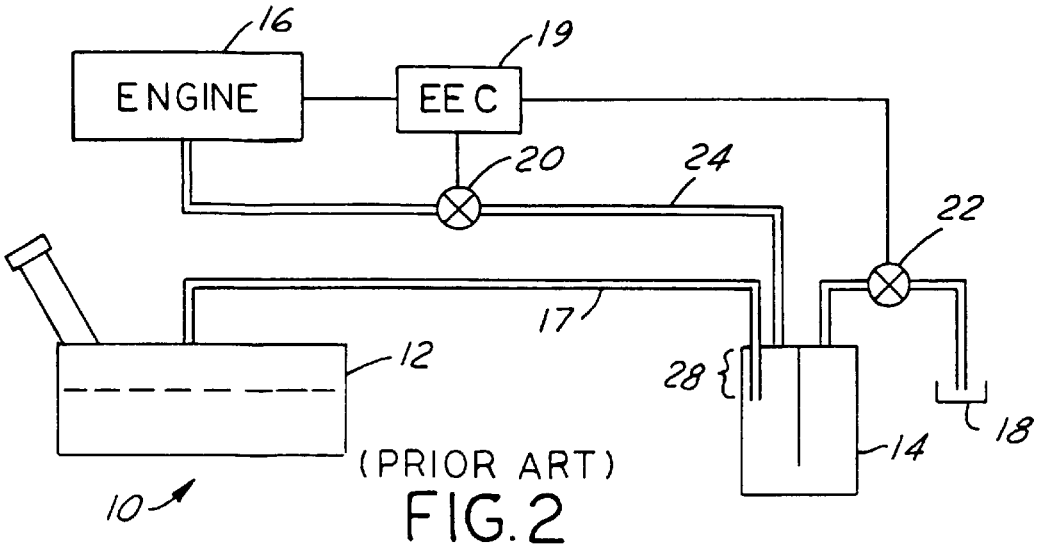
(PRIOR ART) FIG. 2
Figure 3:
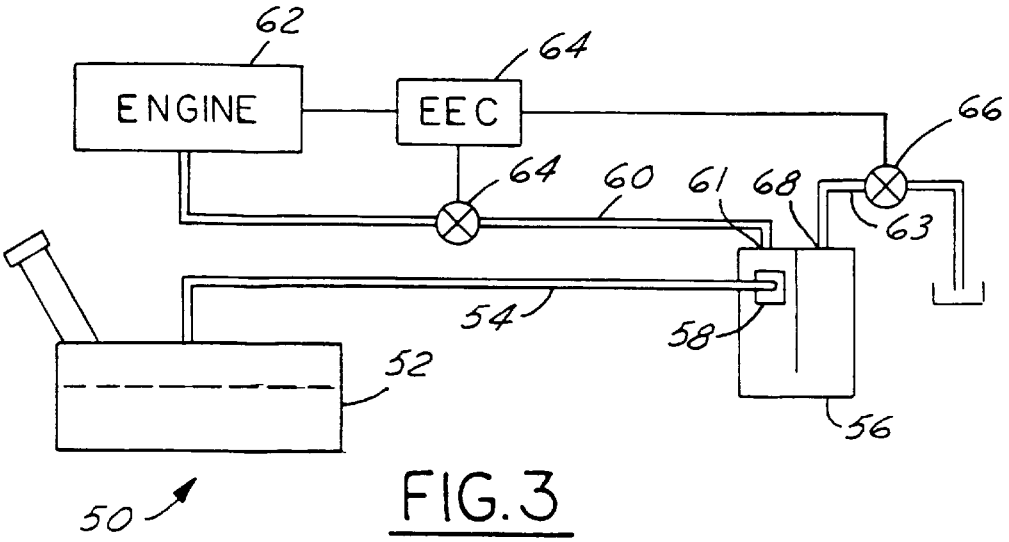
FIG. 3 is a schematic representation of an evaporative emission system for an automotive vehicle according to the present invention.

Turning first to FIG. 3, evaporative emissions system 50 includes fuel tank 52 connected to tank vapor purge line 54.

Tank vapor purge line 54 is connected to evaporative emissions canister 56 which, in this example, includes a bed of activated carbon to adsorb hydrocarbon emissions from fuel tank 52. Purge line 54 is connected to canister 56 via connector 58. Engine purge line 60 is connected to canister 56 via purge port 61 and communicates between canister 56 and engine 62. Vent line 63 is connected to canister 56, via vent port 68, to vent air to atmosphere. Vapor management valve 64, which is a conventional solenoid actuated valve, is disposed within line 60 and is controlled by engine controller 69. Canister vent valve 66, which may also be a solenoid actuated valve connected to controller 69, is normally open. Valve 66 is closed upon conduction of on-board diagnostic testing (OBD), as is well known to those skilled in the art.

As the volume of vapor increases in fuel tank 52, the vapor flows through line 54 to canister 56 where the hydrocarbons are adsorbed and air passes through vent line 63 to the atmosphere. Thus, as is well known to those skilled in the art, canister 56 acts to store hydrocarbons while preventing their release to the atmosphere. Upon purging canister 56, valve 64 is opened and the engine's vacuum serves to draw fresh air through vent port 68 so as to desorb the hydrocarbons stored in canister 56. The hydrocarbons thus released are then routed, via line 60, to engine 62 to be consumed therein.

Figure 4:
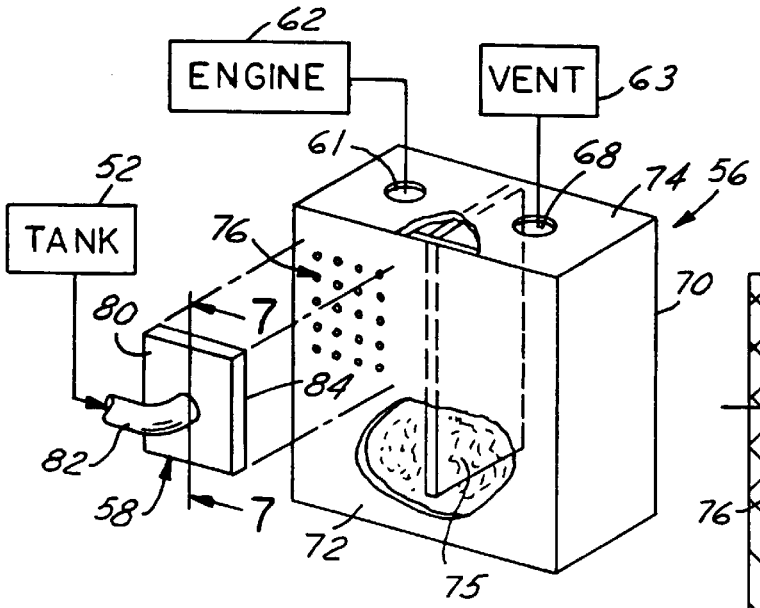
FIG. 4 is a perspective view of an evaporative emissions canister used in the system of FIG. 3.
Figure 5:
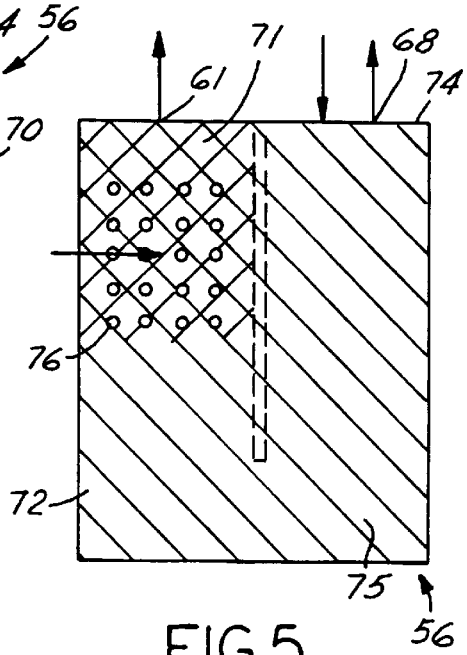
FIG. 5 is a schematic representation of the canister of FIG. 4.
Figure 7:
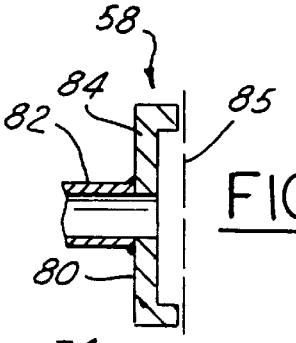

According to the present invention, as best shown in FIGS. 4, 5 and 7, canister 56 includes housing 70 having side walls 72 and a top wall 74. Housing 70 contains hydrocarbon adsorbing material 75, such as carbon, for adsorbing fuel vapor flowing therethrough. Ports 61, 68 are formed through top wall 74 and are adapted for connection to engine 62, via line 60, and line 63, respectively.

A plurality of holes 76 is formed through side wall 72 of housing 70, with the holes being formed at a location remote from port 61, between ports 61 and 68 to define buffer zone 78, shown schematically with reference to FIG. 5. Holes 76 are sufficiently sized to prevent any hydrocarbon adsorbing material from leaving the canister. Connector 58, which includes connector housing 80, connector portion 82 and plenum portion 84 (see FIG. 7), attaches to sidewall 72 away from holes 76 such that fuel vapor may flow through holes 76. That is, plenum portion 84 is recessed relative to plane 85 of sidewall 72 (see FIG. 7).

Canister system flexibility may be achieved because a standard canister may be adapted to provide the function according to the present invention. For example, a standard, off the shelf, canister may be modified by drilling, piercing or coring the plurality of holes 76 through side wall 72 at an appropriate location to create the desired buffered zone 78 to fit a particular vehicle line. Thus, connector 58 may then be attached to side wall 72 to cover the plurality of holes 76, as previously described. In some instances, it may be desirable to create a relatively large buffer zone, thereby requiring that the holes 76 be formed at a location remote from port 61, whereas in other situations, a relatively small buffer zone may be desirable, in which case, the holes 76 are formed adjacent port 61. Thus, any number of vehicle line evaporative emissions system configurations may be achieved by adapting a typical carbon canister.

Figure 6A:
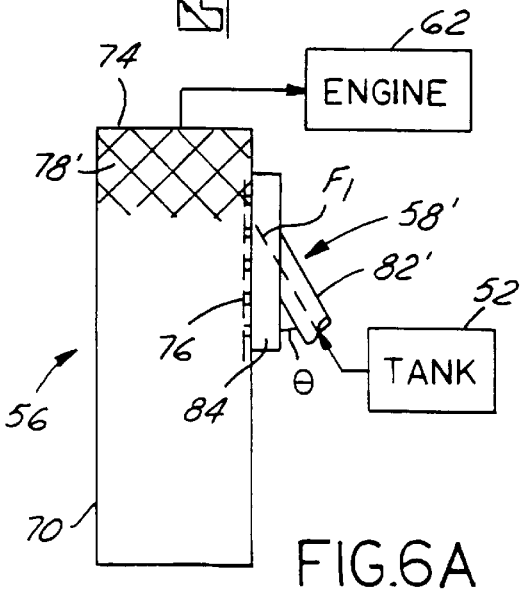
FIGS. 6*a* and 6*b* are side views of an alternative embodiment of the canister of FIGS. 3–5; and, FIG. 7 is a cross-sectional view of a portion of the canister taken along line 7—7 of FIG. 4.
Figure 6B:
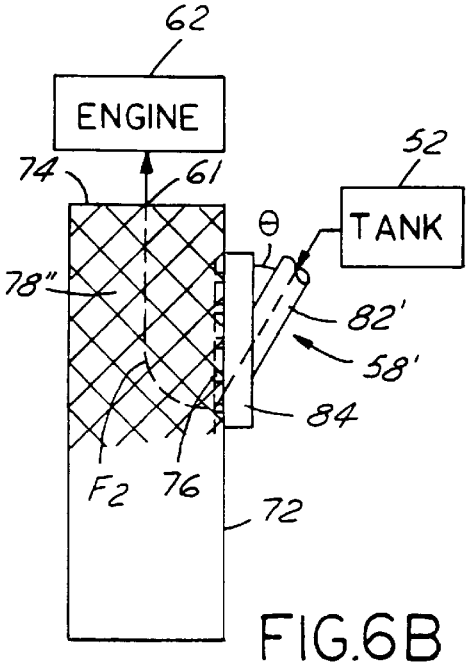

In an alternative embodiment of the present invention, as shown in FIGS. 6*a* and 6*b*, connector 58' may be formed in such a way so as to angle connector portion 82' relative to plenum portion 84 at an angle θ, which is aperpendicular to the plane of plenum 84. In this manner, a single connector may be used to direct the vapor flow to a preset, or pre-drilled, canister. Thus, as shown in FIG. 6*a*, when connector 58' is positioned such that connector portion 82' causes vapor flow ($F_1$) to flow toward port 61, a relatively small buffer zone 78' is created. As previously described, this may be desirable in certain vehicle line instances. As shown in FIG. 6*b*, the same connector 58' may be oriented 180° relative to that shown in FIG. 6*a* such that connector portion 82' causes vapor flow ($F_2$) to initially flow away from port 61. Thus a relatively large buffer zone 78" is created, which may be used in other vehicle line instances.

Thus, in this alternative embodiment of the present invention, a canister having the holes formed in the side wall thereof may be used in all vehicle applications by merely changing the orientation of the connector housing to achieve the desired size of the buffer zone. Those skilled in the art will recognize in view of this disclosure that other means may used to direct the vapor flow into the canister in a manner to define relatively large or small buffer zones. For example, the connector may include a vane in the connector portion to direct the flow.

While the best mode for carrying out the invention has been described in detail, those skilled in the art in which this invention relates will recognize various alternative designs and embodiments, including those mentioned above, in practicing the invention that has been defined by the following claims.

We claim:

1. An evaporative emissions canister for an evaporative emission system, the system having a fuel tank coupled to an engine via a vapor purge line, said canister coupled to the fuel tank and the engine, said canister comprising:

a housing having sidewalls and a top wall, with said housing containing hydrocarbon adsorbing material for adsorbing hydrocarbons from fuel vapor flowing therethrough;

a vent port for venting air to atmosphere upon adsorption of hydrocarbons and for admitting air upon Resorption of hydrocarbons during a purging operation of said canister formed on said housing;

a purge port adapted for connection to the engine to allow desorbed hydrocarbon to flow thereto formed on said housing; and, a plurality of holes formed through a sidewall of said housing, with said holes being formed at a location remote from said purge port between said vent port and said purge port to define a buffer zone between said holes and said purge port, with said holes being adapted for communication with the fuel tank to allow fuel vapor to flow from the tank through said plurality of holes into said buffer zone.

2. A canister according to claim 1 further comprising a connector housing attached to said sidewall of said canister housing and covering said holes, with said connector housing being adapted for connection to the fuel tank.

3. A canister according to claim 1 wherein said purge port is formed on said top wall.

4. A canister according to claim 1 wherein said vent port is formed on said top wall.

5. A canister according to claim 1 wherein said plurality of holes are each sized to prevent said hydrocarbon adsorbing material from exiting said housing.

6. A canister according to claim 2 wherein said connector housing comprises a plenum portion and a connector portion, with said plenum portion being spaced from said plurality of holes to distribute the fuel vapor to the plurality of holes.

7. A canister according to claim 6 wherein said connector comprises a means for directing vapor flow into said canister to create one of a relatively small buffer zone and a relatively large buffer zone.

8. A canister according to claim 6 wherein said connector portion intersects said plenum portion at an aperpendicular angle such that said plenum may be selectively oriented and attached to said housing to create one of a relatively large buffer zone and a relatively small buffer zone.

9. An evaporative emissions canister for an evaporative emission system, the system having a fuel tank coupled to an engine via a vapor purge line, said canister coupled to the fuel tank and the engine, said canister comprising:

a housing having sidewalls and a top wall, with said housing containing hydrocarbon adsorbing material for adsorbing hydrocarbons from fuel vapor flowing therethrough;

a vent port for venting air to atmosphere upon adsorption of hydrocarbons and for admitting air upon desorption of hydrocarbons during a purging operation of said canister formed on said housing;

a purge port formed in said top wall and adapted for connection to the engine to allow desorbed hydrocarbon to flow thereto formed on said housing;

a plurality of holes formed through a sidewall of said housing, with said holes being formed at a location remote from said purge port between said vent port and said purge port to define a buffer zone between said holes and said purge port, with said holes being adapted for communication with the fuel tank to allow fuel vapor to flow from the tank through said plurality of holes into said buffer zone; and, a connector housing attached to said sidewall of said canister housing and covering said holes, with said connector housing having a plenum portion and a connector portion, with said plenum portion being spaced from said plurality of holes to distribute the fuel vapor to the plurality of holes, with said connector portion being adapted for connection to the fuel tank.

10. A canister according to claim 9 wherein said connector portion intersects said plenum portion at an aperpendicular angle such that said plenum may be selectively oriented and attached to said housing to create one of a relatively large buffer zone and a relatively small buffer zone.

11. An evaporative emissions system, comprising:

a fuel tank coupled to an engine via a vapor purge line; and, a canister coupled to said fuel tank and said engine, said canister comprising:

a housing having sidewalls and a top wall, with said housing containing hydrocarbon adsorbing material for adsorbing hydrocarbons from fuel vapor flowing therethrough;

a vent port for venting air to atmosphere upon adsorption of hydrocarbons and for admitting air upon desorption of hydrocarbons during a purging operation of said canister formed on said housing;

a purge port adapted for connection to the engine to allow desorbed hydrocarbon to flow thereto formed on said housing; and, a plurality of holes formed through a sidewall of said housing, with said holes being formed at a location remote from said purge port between said vent port and said purge port to define a buffer zone between said holes and said purge port, with said holes being adapted for communication with the fuel tank to allow fuel vapor to flow from the tank through said plurality of holes into said buffer zone.

12. A system according to claim 11 wherein said canister further comprises a connector housing attached to said sidewall of said canister housing and covering said holes, with said connector housing being adapted for connection to said vapor purge line.

13. A system according to claim 11 wherein said purge port is formed on said top wall.

14. A system according to claim 11 wherein said vent port is formed on said top wall.

15. A system according to claim 11 wherein said plurality of holes are each sized to prevent said hydrocarbon adsorbing material from exiting said housing.

16. A system according to claim 11 wherein said connector housing comprises a plenum portion and a connector portion, with said plenum portion being spaced from said plurality of holes to distribute the fuel vapor to the plurality of holes.

17. A system according to claim 16 wherein said connector comprises a means for directing vapor flow into said canister to create one of a relatively small buffer zone and a relatively large buffer zone.

18. A system according to claim 16 wherein said connector portion intersects said plenum portion at an aperpendicular angle such that said plenum may be selectively oriented and attached to said housing to create one of a relatively large buffer zone and a relatively small buffer zone.

* * * * *